US008353413B2

(12) United States Patent
Ekkert

(10) Patent No.: US 8,353,413 B2
(45) Date of Patent: Jan. 15, 2013

(54) TAMPER-EVIDENT CLOSURE AND CONTAINER COMBINATION

(75) Inventor: Len Ekkert, Naperville, IL (US)

(73) Assignee: Phoenix Closures, Inc., Naperville, IL (US)

( * ) Notice: Subject to any disclaimer, the term of this patent is extended or adjusted under 35 U.S.C. 154(b) by 367 days.

(21) Appl. No.: 11/620,410

(22) Filed: Jan. 5, 2007

(65) Prior Publication Data

US 2008/0164235 A1 Jul. 10, 2008

(51) Int. Cl.
*B65D 39/00* (2006.01)

(52) U.S. Cl. ..... 215/252; 215/258

(58) Field of Classification Search ..... 215/252, 215/43, 46, 258, 344, 352; 220/DIG. 34
See application file for complete search history.

(56) References Cited

U.S. PATENT DOCUMENTS

| | | | | | |
|---|---|---|---|---|---|
| 2,990,076 | A | * | 6/1961 | Stull | 215/46 |
| 3,273,737 | A | * | 9/1966 | Davie | 215/255 |
| 4,257,526 | A | * | 3/1981 | Weits et al. | 215/332 |
| 4,478,343 | A | | 10/1984 | Ostrowsky | |
| 4,497,765 | A | | 2/1985 | Wilde et al. | |
| 4,506,795 | A | | 3/1985 | Herr | |
| 4,511,053 | A | | 4/1985 | Brandes et al. | |
| 4,511,054 | A | | 4/1985 | Shank | |
| 4,550,844 | A | | 11/1985 | Lininger | |
| 4,595,110 | A | | 6/1986 | Herr | |
| 4,609,115 | A | | 9/1986 | Moore et al. | |
| 4,782,968 | A | * | 11/1988 | Hayes | 215/276 |
| 4,796,770 | A | * | 1/1989 | Begley | 215/252 |
| 4,801,030 | A | * | 1/1989 | Barriac | 215/252 |
| 4,807,770 | A | | 2/1989 | Barriac | |
| 4,807,771 | A | | 2/1989 | Roy et al. | |
| 4,848,614 | A | | 7/1989 | Csaszar | |
| 4,913,299 | A | | 4/1990 | Petro | |
| 4,989,740 | A | * | 2/1991 | Vercillo | 215/252 |
| 5,027,964 | A | * | 7/1991 | Banich, Sr. | 215/252 |
| 5,107,998 | A | | 4/1992 | Zumbuhl | |
| 5,129,530 | A | | 7/1992 | Fuchs | |
| 5,246,125 | A | * | 9/1993 | Julian | 215/252 |
| 5,282,540 | A | | 2/1994 | Beck | |
| 5,292,020 | A | | 3/1994 | Narin | |
| 5,356,019 | A | * | 10/1994 | Kelly | 215/252 |
| 5,397,009 | A | | 3/1995 | Salmon et al. | |
| 5,488,888 | A | * | 2/1996 | Kowal | 83/880 |
| 5,560,504 | A | * | 10/1996 | Molinaro | 215/256 |
| 5,593,055 | A | * | 1/1997 | Repp et al. | 215/256 |
| 5,611,446 | A | * | 3/1997 | Ingram et al. | 215/252 |
| 5,657,889 | A | | 8/1997 | Guglielmini | |
| 5,660,289 | A | | 8/1997 | Spatz et al. | |
| 5,725,115 | A | | 3/1998 | Bösl et al. | |
| 5,755,347 | A | | 5/1998 | Ingram | |
| 5,775,527 | A | | 7/1998 | Bösl et al. | |
| 5,779,086 | A | * | 7/1998 | Barrash | 220/240 |
| 5,806,700 | A | * | 9/1998 | Henning | 215/328 |
| 5,967,351 | A | | 10/1999 | Ekkert | |
| 6,253,939 | B1 | | 7/2001 | Wan et al. | |
| 6,260,722 | B1 | * | 7/2001 | Ekkert | 215/331 |

(Continued)

*Primary Examiner* — Anthony Stashick
*Assistant Examiner* — Brett Edwards
(74) *Attorney, Agent, or Firm* — Husch Blackwell LLP

(57) ABSTRACT

A tamper-evident closure and container combination identifies a compromised seal when a severable ring has been detached from a closure upon a first opening of the container. Successful detachment of the severable ring is improved whereby a lower neck portion of a container is angled or arced downwardly and outwardly from a point immediately adjacent an annular ring.

10 Claims, 6 Drawing Sheets

U.S. PATENT DOCUMENTS 6,325,227 B1 * 12/2001 Ekkert ..... 215/252
6,371,317 B1 * 4/2002 Krueger ..... 215/252
6,405,886 B1 6/2002 Gearhart et al.
6,637,611 B2 * 10/2003 Luch ..... 215/256
6,729,488 B2 5/2004 McNary et al.
6,779,672 B2 8/2004 Kano et al.
6,968,966 B2 11/2005 Gregory
6,974,046 B2 * 12/2005 Shenkar ..... 215/252
7,059,485 B1 * 6/2006 Reidenbach ..... 215/252
7,228,979 B2 * 6/2007 Long, Jr. ..... 215/252
2001/0002661 A1 6/2001 Reidenbach
2002/0096485 A1 7/2002 Zumbuhl
2004/0074861 A1 4/2004 Chuang et al.
2005/0000931 A1 1/2005 Bösl et al.
2005/0029217 A1 2/2005 Dai
2005/0189312 A1 9/2005 Bixler et al.
2005/0252878 A1 11/2005 Babcock

* cited by examiner

TAMPER-EVIDENT CLOSURE AND CONTAINER COMBINATION

FIELD OF THE INVENTION

This invention relates to a closure and container combination.

BACKGROUND OF THE INVENTION

Maintaining and ensuring the proper sealing of container and closure combinations are important considerations for many different kinds of packaged products, such as food, beverages, and pharmaceuticals. A compromised seal can result in the introduction of atmospheric and other forms of contamination into the container system. Contaminants introduced through a compromised seal can be detrimental to the vitality of the container contents, reduce shelf-life, and may pose significant health risk when the contents are intended for human consumption. A compromised seal, however, can be difficult to detect by consumers and individuals handling packaged goods.

Tamper-evident closures can assist consumers and individuals handling packaged goods to easily detect compromised closures. For example, a first opening of a closure and container combination can be visually and audibly detected where tamper-evident means are in the form of a detachable ring that breaks and separates from the closure means upon opening. An individual can easily discern the detached ring and will recognize the container and closure combination has been compromised. Recognizing the compromised seal consumers can select an uncompromised product and individuals handling packaged products for sale can choose to return the compromised goods to the manufacturer and/or to discard the goods.

The usefulness of the tamper-evident closure depends on the successful identifying characteristic being generated in every case where the container and closure system has been compromised. A failure rate, even when low, may be particularly unacceptable when the contents of the container and closure combination are intended for human consumption or use. Therefore, it is desirable to develop a tamper-evident closure that succeeds in identifying a compromised closure each time the container contents have been introduced to potential environmental contaminants.

SUMMARY OF THE INVENTION

It is an object of the present invention to have a tamper-evident closure and container combination with improved performance characteristics.

Accordingly, the foregoing objectives are provided for in a molded tamper-evident closure and container combination. A container is provided with a neck portion having an uppermost and lowermost portion. The uppermost neck portion is provided with means for securing a closure. In one embodiment of the invention, the uppermost neck portion is provided with threads integrally formed therein. At the periphery between the uppermost and lowermost neck portion an annular shoulder is provided with a downwardly and outwardly sloping upper portion and a lowermost portion that is angled downwardly and inwardly. The circumference of the annular shoulder at its greatest extent is greater than the circumference of the adjacent neck portions where they abut the annular shoulder. The lowermost neck portion slopes or arcs outwardly from below the annular shoulder such that the circumference immediately adjacent the annular shoulder is less than the circumference at a more distal portion as the lowermost neck portion approaches the container body.

A closure is provided with a top wall portion that spans the uppermost portion of the container neck and may be provided with sealing means to provide a sealed closure. An annular sidewall is attached to the periphery of the top wall and extends downward. An integral screw thread is provided at the inner surface of the sidewall and matingly engages the threads integrally formed in the uppermost portion of the container neck. In an alternative embodiment, the closure is provided with snapping means for securing the closure to the container. Instead of an integral screw thread, one or more ridges are formed at the inner surface of the closure sidewall and slide past and engage one or more integrally formed ridges on the container neck when closing and securing the closure to the container.

At the lower extent of the sidewall tamper-evident means are provided comprising a detachable ring and a plurality of tabs. The detachable ring is in vertical alignment with the sidewall and includes a frangible section that operates to sever the ring from the closure when the cap is removed, for example by unscrewing or snapping off the closure to get at the contents of the container. At a lower portion of the detachable ring a plurality of tabs are provided that bend upward and radially inward, pivoting at a joint section located at a lower portion of the detachable ring when the cap and container assembly is in a secured state. The tabs engage the lower portion of the annular shoulder of the container. When the closure is removed, the annular shoulder resists the upward movement of the detachable ring. The sloping lower neck portion braces the tabs tending to prevent a downward movement or unfolding of the tabs at the hinge portion. The detachable ring breaks from the sidewall portion at the frangible section and is retained at the lower extent of the neck portion and below the annular shoulder.

BRIEF DESCRIPTION OF THE DRAWINGS

Further objects of the invention, together with additional features contributing thereto and advantages occurring therefrom, will be apparent from the following description of the invention when read in conjunction with the accompanying drawings; wherein.

DETAILED DESCRIPTION OF THE INVENTION

Figure 1:
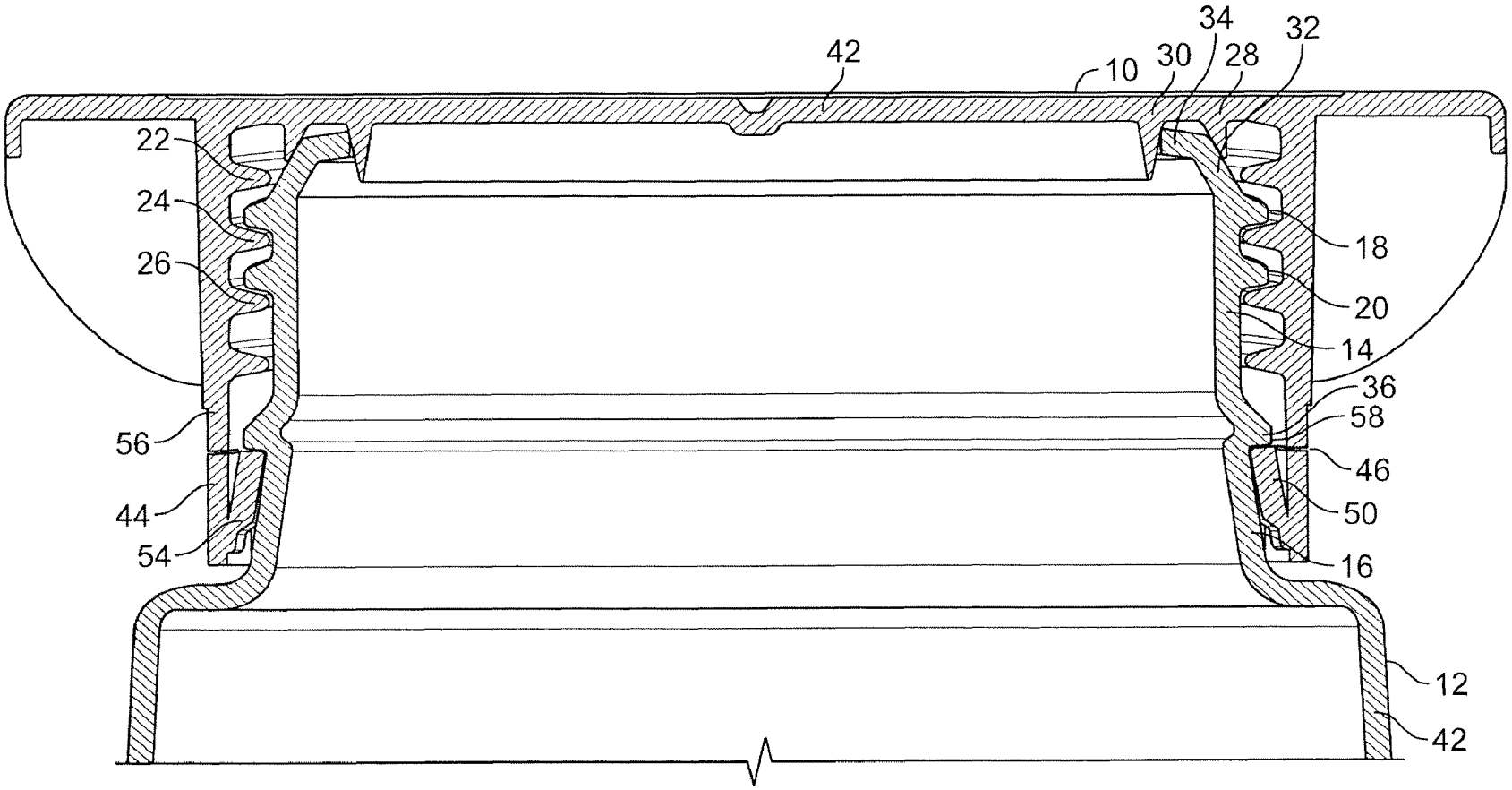
FIG. 1 depicts a partial cross-sectional view of a container with a closure threaded onto the container and tabs engaging an annular shoulder according to one embodiment of the subject invention.

Referring now to FIG. 1 the closure of a specific embodiment of the present invention is designated generally as 10, and is shown mounted upon a container generally designated as 12. The container 12 has an upper 14 and lower 16 neck portion located atop a body portion 42. The container 12 upper neck portion 14 is provided with integral threads 18, 20 formed therein. The integral container threads 18, 20 matingly engage the integral screw threads 22, 24, 26 of the closure 10. In one embodiment of the invention, a proximal 32 and distal 34 segment at the topmost portion of the container 12 upper neck portion 14 may engage outer 28 and inner 30 protuberances of the inner surface of the closure 10 top wall 42 portion to form a mechanical sealing means.

Figure 2:
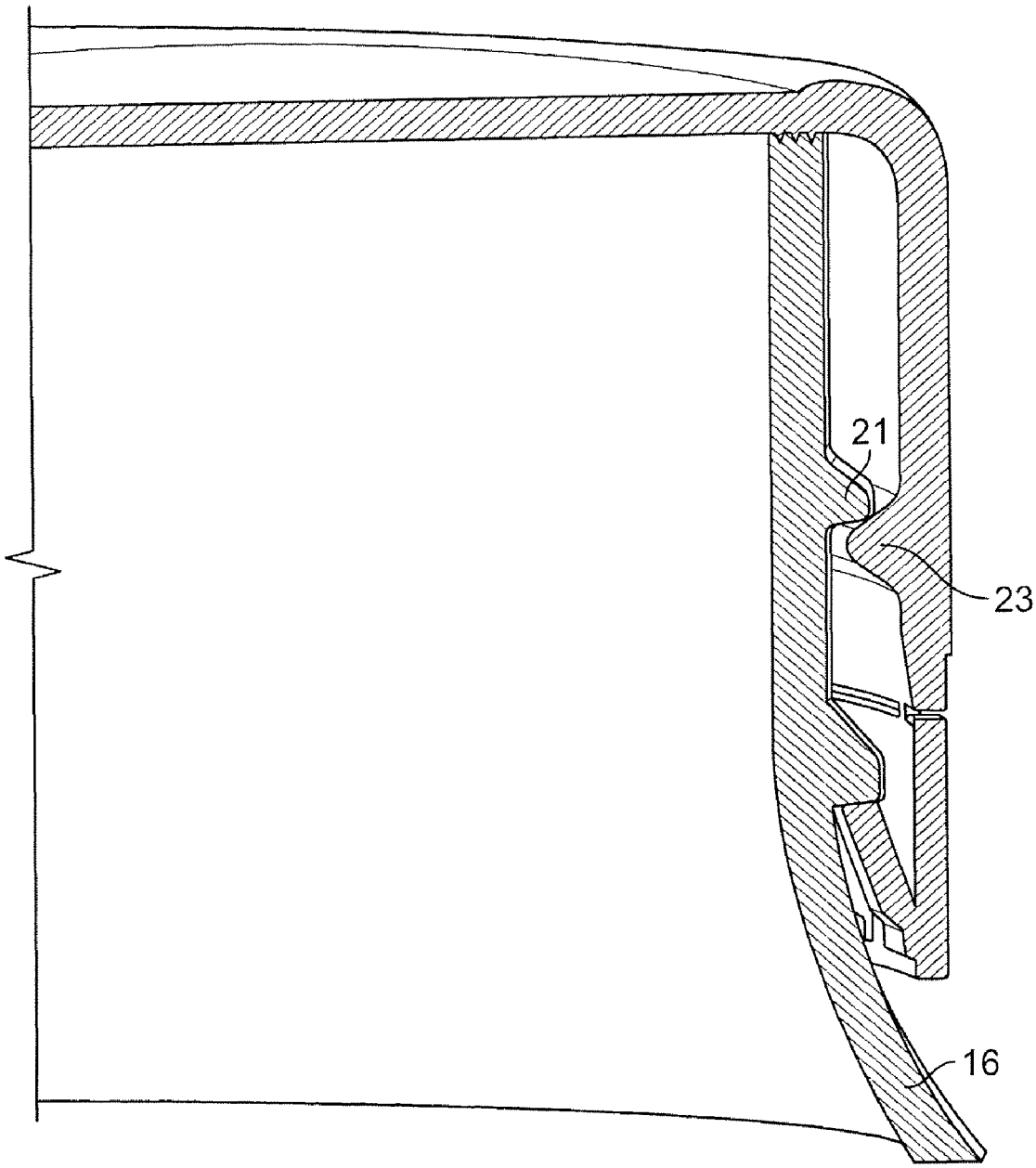
FIG. 2 depicts a partial cross sectional view of a closure snapped onto a container and tabs engaging an annular shoulder according to one embodiment of the subject invention.

Referring now to FIG. 2 an alternative embodiment of the invention includes means for snapping the closure 10 onto the container 12 instead of integral screw threads previously described. The container 12 upper neck portion 14 is provided with an integral ridge 21 formed therein. The integral container ridge 21 engages a corresponding ridge 23 formed at the annular sidewall 56 of the closure 10. When the closure 10 is snapped into place on the container 12, the closure ridge 21 engages the container ridge 23 and assists in the maintenance and integrity of the seal. When the closure 10 is pushed upward the closure snaps off the container 12 and the contents may be obtained. FIG. 2 depicts a single embodiment of the snap-cap feature. However, the invention is not limited to the structure depicted therein and those skilled in the art will recognize, for example, that a plurality of closure and container ridges may be used consistent with the scope of the invention. Persons skilled in the art will also recognize that other closing means known in the art may be substituted in practicing the present invention.

Figure 3:
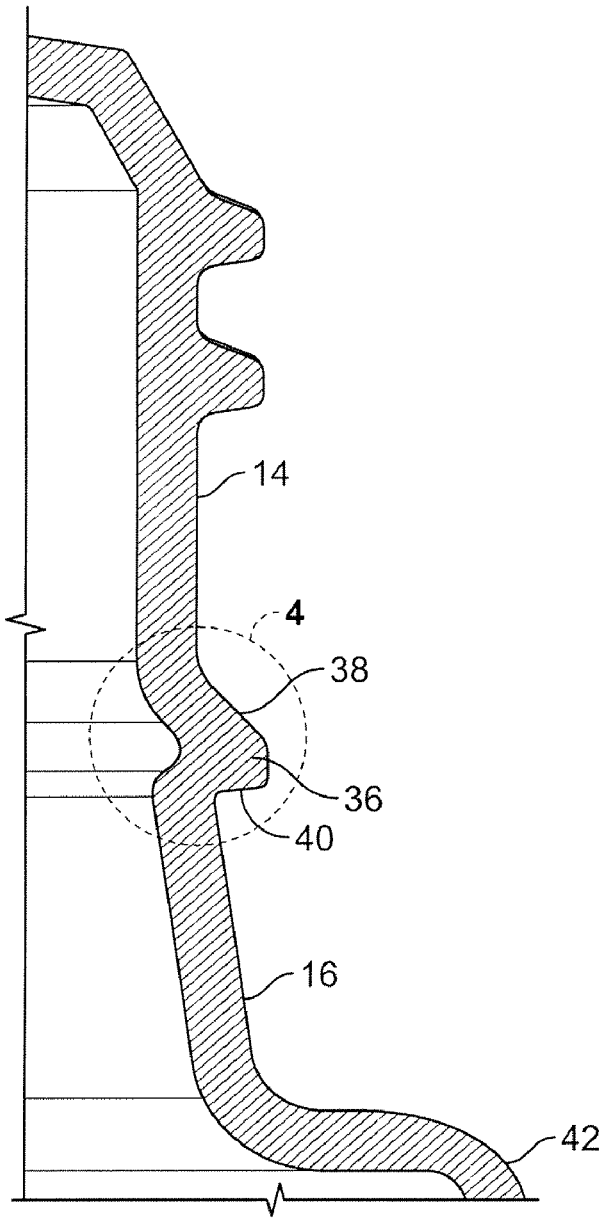
FIG. 3 depicts a partial cross-sectional view of a screw-thread container with integrally formed threads and an annular shoulder.
Figure 4:
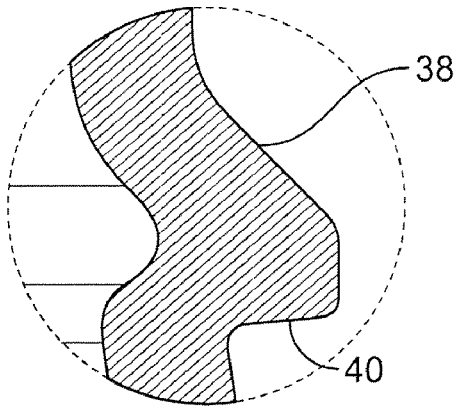
FIG. 4 depicts a partial cross-sectional view of an annular shoulder.

Referring now to FIG. 3 and FIG. 4 an annular shoulder 36 with an upper 38 and lower 40 portion separates the upper 14 and lower 16 neck portions of the container 12. In one embodiment of the invention, the upper portion 38 of the annular shoulder 36 slopes downwardly and outwardly from the adjacent upper neck portion 14 at an angle substantially 45° from a horizontal plane. Alternatively, the upper portion 38 of the annular shoulder may seamlessly transition into a sloping neck portion 14. It will be clear from one skilled in the art that consistent with the scope of the invention alternative angles may be utilized. The lower portion 40 of the annular shoulder 36 may horizontally extend inward from the outermost extent of the shoulder. Alternatively, the lower portion 40 of the annular shoulder 36 extends downwardly and inwardly at an angle ranging from about and including 0 to 15° and preferably 0.5 to 10° from a horizontal plane. At the outermost extent, the circumference of the annular shoulder is greater than the circumference of the upper 14 and lower 16 neck portions immediately adjacent the annular shoulder.

The lower neck portion 16 of the container 12 extends downwardly and outwardly from the lower portion 40 of the annular shoulder 36 to the container body 42. The angle defined by a vertical line drawn downward from the junction of the lower portion 40 of the annular shoulder and the lower neck portion 16 and the downwardly and outwardly extending lower neck portion 16 ranges from about and including 3 to 40.degree. Preferably, the angle defined ranges from about and including 5 to 25°. In the most preferred embodiment the defined angle is 8°.

In one embodiment of the invention, the lower neck portion 16 terminates at a shoulder of the container body 42. In an alternative embodiment, the container body 42 continues at an angle substantially the same as the angle defined by the lower neck portion 16. In general, the lower neck portion will tend to terminate approximately at a location adjacent the lower edge of a closure 10 with attached tamper-evident band 44 described below. In another embodiment of the invention shown in FIG. 2, the lower neck portion 16 defines an arc. The lower neck portion begins to arc at a point adjacent the lower portion 40 of the annular shoulder 36. The arc portion terminates approximately at a location adjacent the lower edge of a closure 10 with attached tamper-evident band 44 described below.

Figure 5:
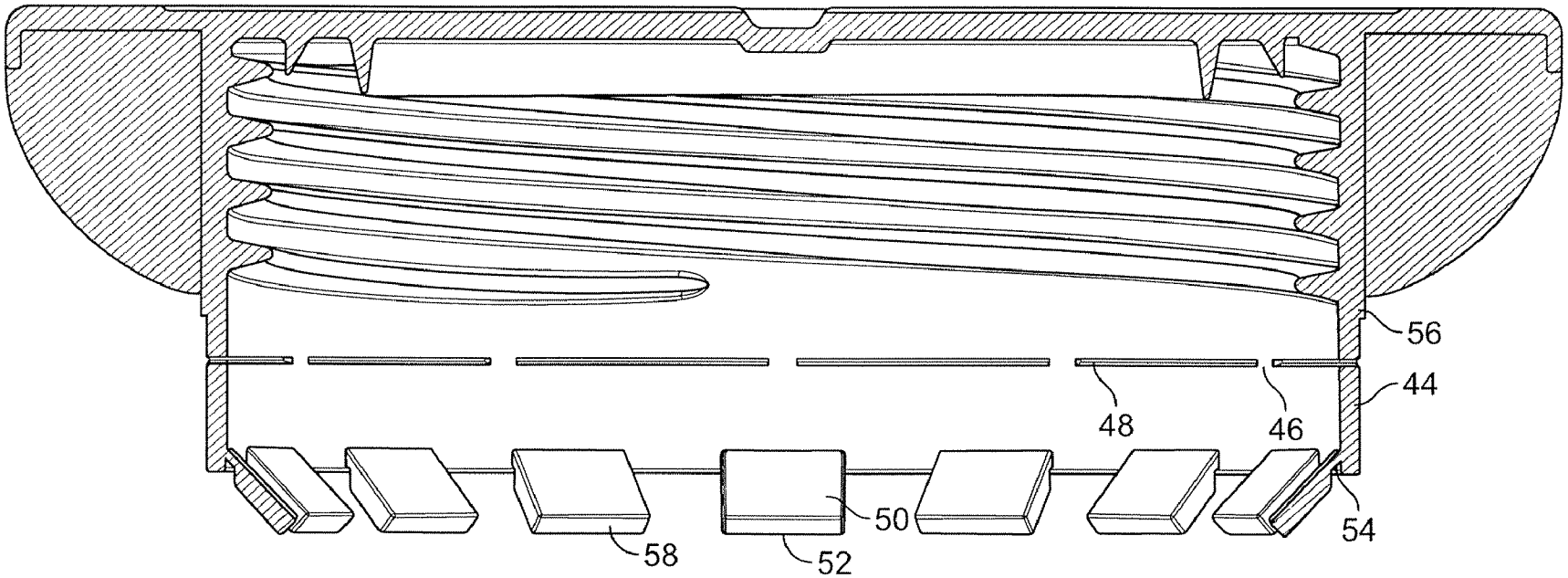
FIG. 5 depicts a cross-sectional view of a closure with an integral screw thread, tamper-evident means in the form of a detachable ring, and tabs depicted in a post-molding position and prior to securing the closure onto a container.

Referring now to FIG. 1 and FIG. 5 a closure 10 is provided with a top wall portion 42 spanning an uppermost neck portion 14 of the container 12. An annular sidewall 56 is attached to a periphery of the top wall 42 and extends downward. In one embodiment of the invention an integral screw thread 22, 24, 26 is provided at the inner surface of the sidewall and matingly engages the threads 18, 20 integrally formed in the uppermost neck portion 14 of the container 12. In an alternative embodiment, the container and closure combination comprises a snap-cap feature, whereby a closure is secured to the container utilizing snapping means. It will be understood by one skilled in the art that the invention can be practiced utilizing known container and closure combinations whereby a tamper-evident means comprising a detachable ring may be used. The invention is not limited by the specific embodiment described herein.

Figure 6:
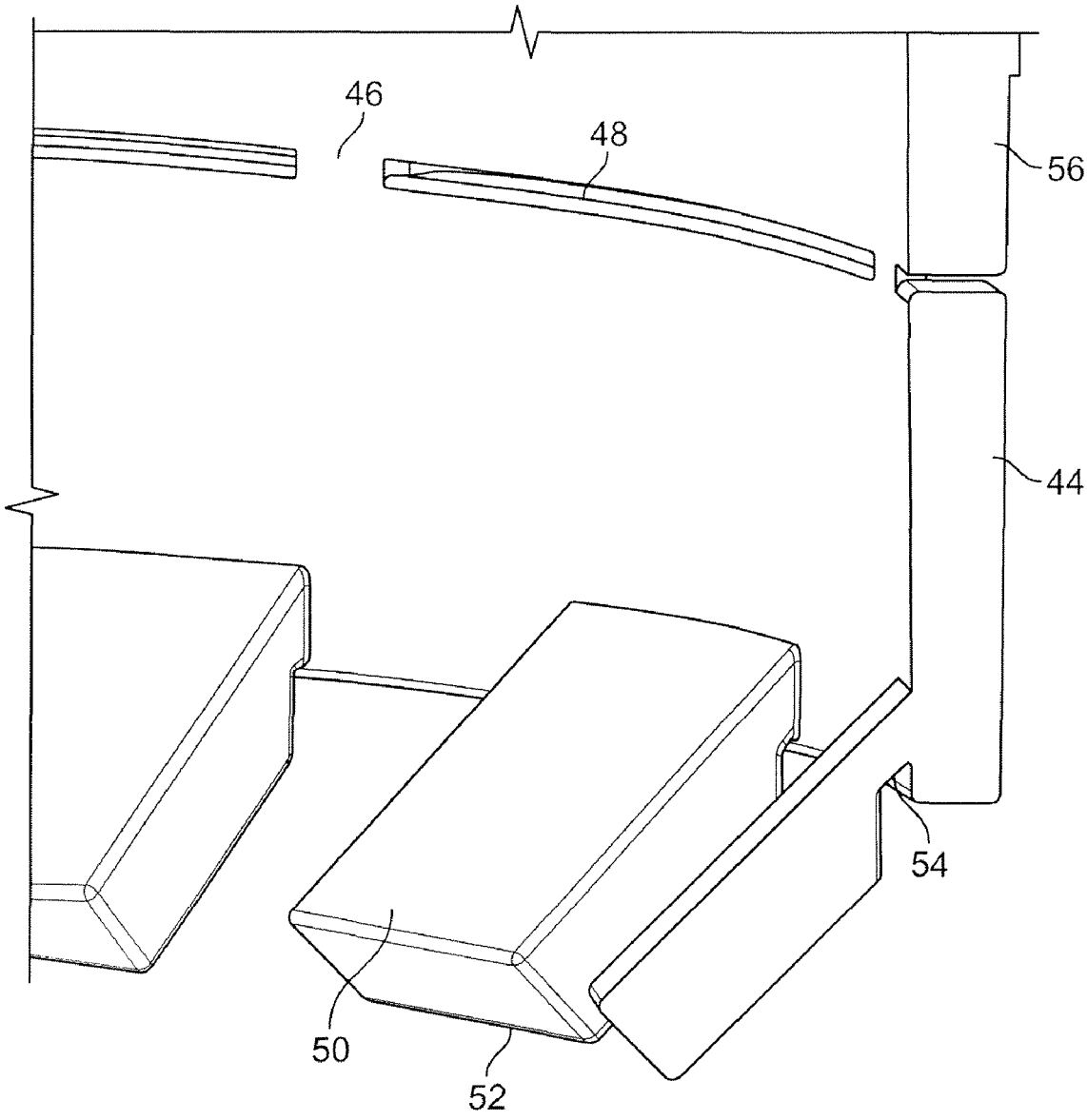
FIG. 6 depicts a partial cross-sectional view of a detachable ring with tabs as molded.
Figure 7:
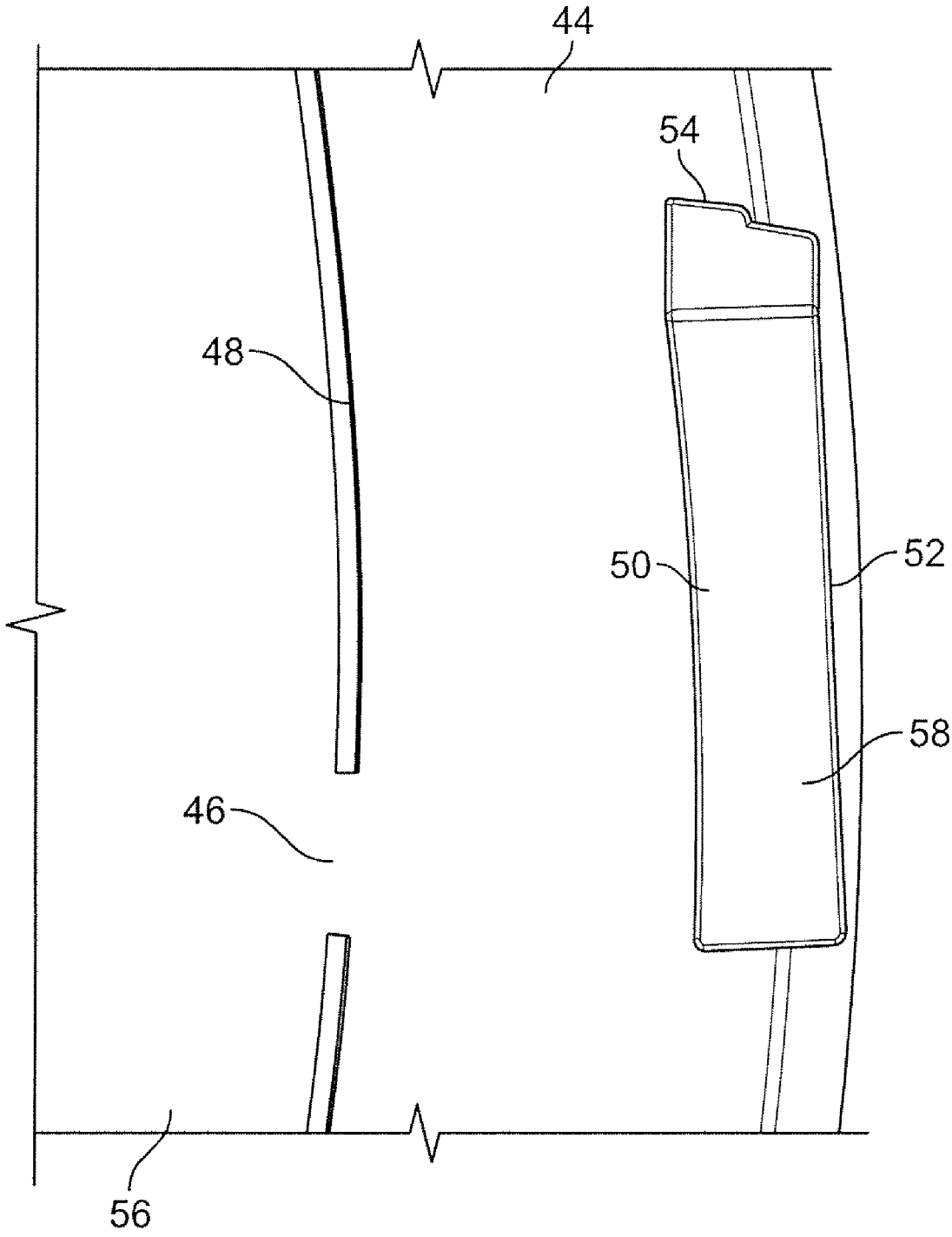
FIG. 7 depicts a partial view of a detachable ring and tabs.

Returning to the closure structure, at the lower extent of the annular sidewall 56 is provided with tamper-evident means comprising a detachable ring 44. The detachable ring 44 is attached to the annular sidewall 56 by a plurality of frangible bridges 46 that extend outwardly from the innermost surface of the closure 10. When the closure 10 is removed from the container 12 the detachable ring is severed from the annular sidewall 56 at the frangible bridge portions 46. At the lowermost inner surface of the detachable ring 44 a plurality of tabs 50 are pivotably and integrally joined at a joint section 54. FIG. 5 and FIG. 6 depict a preferred embodiment of the invention whereby the tabs 50 are contiguous with the detachable ring 44 and angle downward and inwardly from the lowermost inner portion prior to securing the closure 10 on the container 12. As the closure 10 is initially secured to the container 12 to form a seal protecting the contents of the container from contaminants, the tabs 50 pivot upward at the flexible joint 54 and come to rest with an engaging surface 58 that engages the lowermost portion 40 of the annular shoulder. When the engaging surface 58 of the tabs 50 are engaging the lowermost portion 40 of the annular shoulder the resting surface 52 abuts in whole or in part the lowermost neck portion 16 of the container 12.

FIG. 1 and FIG. 2 depict partial cross-sections of specific embodiments of the closure 10 and container 12 combination after the closure has been attached and sealed to the container. The tabs 50 engage the lowermost portion 40 of the annular shoulder 36 and the resting surface 52 of the tabs 50 abut the angled lower neck portion 16 of the container 12. In FIG. 1, turning the closure 10 counterclockwise produces an upward force applied by the engaging surface 58 at the lowermost portion 40 of the annular shoulder 36 while in FIG. 2 an identical force is generated by lifting the snap-cap closure. The substantially inflexible annular shoulder 36 produces a force that is equal and opposite the force applied by the tabs 50 preventing them from moving upward as the closure 10 is unscrewed or lifted. As an upward force is continually applied while the closure 10 is unscrewed or lifted upward force on the detachable ring coupled with the downward equal-and-opposite force applied the engaging surface 58 of the tabs cause flexing at the pivotal joint member 54 and the tabs 50 will tend to pivot downward. As the tabs 50 tend to pivot downwardly they slide across the angled or arced lowermost neck portion 16 of the container 12 producing an outward force at the lowermost portion of the detachable ring 44. The detachable ring 44 flexes outward, thereby stressing the frangible bridge portions 46 connecting the detachable ring 44 to the annular side ring 56 of the closure 10. When sufficient stress has been applied the bridge portions 46 break, severing the detachable ring 44 from the annular side wall 56 and evidencing an initial opening of the closure and container combination.

In prior art systems, the lower neck portion of the container 16 was substantially perpendicular to a horizontal plane thereby allowing the tabs to pivot too far in a downward direction and resulting in insufficient stress at the outermost region of the detachable ring. Occasionally the detachable ring would fail to sever from the closure and the tamper-evident characteristic would not be generated. The container could be recapped and a consumer or person handling sealed goods could not easily detect the contents of the container had been compromised.

The present invention has improved performance characteristics due to the angled or arced lower neck portion 16 that prevents the tabs 50 from flexing too far in a downwardly direction as the closure is being removed. Sufficient outward force is therefore transmitted to the detachable ring 44 causing the frangible bridge portions to break at an increased and improved rate. This improved performance ensures the tamper-evident characteristic is being generated by both an audible and visual first opening of the closure and container combination.

A specific embodiment of a tamper-evident closure and container combination according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A closure and container combination comprising:

a one-piece plastic closure having a top wall, an annular sidewall, closure threads on the annular sidewall and a detachable ring;

a container having a neck with threads on an upper portion for engaging the closure threads, an annular shoulder underneath said threads dividing said upper neck portion from a lower neck portion, for engaging the detachable ring, said annular shoulder having a lower shoulder portion meeting said lower neck portion along a circumferential line about the neck, said lower shoulder portion having an inward and downward angle, said lower neck portion extending simultaneously downwardly and outwardly from said circumferential line;

the annular sidewall having a top portion and a lower portion, a bridge portion severably connecting the detachable ring to the lower annular sidewall portion at an upper portion of the detachable ring, the detachable ring having a lower portion, and a plurality of tabs connected to the lower ring portion, said tabs comprising a plurality of discrete generally elongated finger of substantially uniform width and a substantially flat inner surface, whereby substantially the entire inner surface of each said tab contacts and initially conforms to an outer surface of said lower neck portion and subsequently during removal of said closure from said container, moves away from said outer surface, said tabs initially extending away from said top wall and engaging said shoulder and said annular side wall along said circumferential line upon removal of said closure from said container, said tabs extending towards said top wall when engaging said shoulder and said annular side wall and restrained from downward movement by said downward and outward extension of said lower neck portion upon said removal.

2. A closure and container combination according to claim 1, wherein said threads are integrally formed therein and matingly engage a closure with integral thread portions located at the inner sidewall of the annular ring.

3. A closure and container combination according to claim 1, wherein the annular shoulder has an upper and lower portion, the lower portion of the annular shoulder being angled inwardly and downwardly from a horizontal plane.

4. A closure and container combination according to claim 1, wherein the lower neck portion defines an angle about and including 8 degrees with respect to vertical.

5. A closure and container combination according to claim 1, wherein the lower neck portion defines an arc.

6. A closure and container combination according to claim 1 wherein the lower neck portion defines an angle about 5 to about 25 degrees with respect to vertical.

7. A closure and container combination according to claim 1 whereby said lower shoulder portion has an angle of about 0.5 degrees to about 10 degrees.

8. A closure and container combination comprising:

a one-piece plastic closure having a top wall, an annular sidewall with closure threads, and a tamper-evident band;

a container having a neck with neck threads for engaging said closure threads, an annular shoulder for engaging the tamper-evident band on the neck, said annular shoulder being underneath said neck threads, and having a lower shoulder portion meeting said lower neck portion along a circumferential line about the neck, said lower shoulder portion having an inward and downward angle with respect to horizontal, said lower neck portion extending simultaneously downwardly and outwardly from said circumferential line;

the tamper-evident band having a bridge portion severably connecting the tamper-evident band to said annular sidewall, a plurality of discrete tabs, each comprising an elongated finger of substantially uniform width connected to the tamper-evident band, each of said tabs having an inner surface, said plurality of tabs in a first unengaged position initially extending away from said top wall and in a second engaged position said inner surface is parallel to and initially contacting said lower neck portion along the entire length of said inner surface, while subsequently moving outwardly away from said lower neck portion during removal of said closure from said container said tabs extending towards said top wall when engaging said annular shoulder and said lower neck portion along said circumferential line upon removal of said closure from said container thereby retaining said closure on said container in a tamper-evident manner whereby the lower neck portion maintains the tabs engaged with said annular shoulder.

9. A closure and container combination according to claim 8 wherein the lower neck portion defines an angle about 5 to about 25 degrees with respect to vertical.

10. A closure and container combination according to claim 8 whereby said lower shoulder portion has an angle of about 0.5 degrees to about 10 degrees.

* * * * *